US007106011B2

(12) United States Patent
Hanson

(10) Patent No.: US 7,106,011 B2
(45) Date of Patent: Sep. 12, 2006

(54) WEB ROLLER ASSIST DRIVE

(75) Inventor: Dennis Hanson, Belvidere, IL (US)

(73) Assignee: Larson Burton, Inc., Loves Park, IL (US)

( * ) Notice: Subject to any disclaimer, the term of this patent is extended or adjusted under 35 U.S.C. 154(b) by 61 days.

(21) Appl. No.: 10/971,652

(22) Filed: Oct. 22, 2004

(65) Prior Publication Data

US 2005/0127126 A1 Jun. 16, 2005

Related U.S. Application Data

(60) Provisional application No. 60/513,262, filed on Oct. 22, 2003.

(51) Int. Cl.
*B65H 27/00* (2006.01)

(52) U.S. Cl. ..... 318/14; 318/538; 318/690; 226/188

(58) Field of Classification Search ..... 318/6, 318/7, 9, 14, 685, 690–695, 720–724, 254, 318/443, 538, 558; 226/188
See application file for complete search history.

(56) References Cited

U.S. PATENT DOCUMENTS

| | | | | |
|---|---|---|---|---|
| 2,559,734 | A | 7/1951 | Reid | |
| 3,221,389 | A | 12/1965 | Cowell | |
| 3,899,070 | A | 8/1975 | Lang | |
| 4,131,828 | A | 12/1978 | Houshi | |
| 4,342,432 | A * | 8/1982 | Lund et al. | 242/530.4 |
| 4,516,739 | A | 5/1985 | Wyatt | |
| 4,915,282 | A | 4/1990 | Martin et al. | |
| 5,569,967 | A | 10/1996 | Rode | |
| 5,671,895 | A | 9/1997 | Cederholm et al. | |
| 5,682,586 | A | 10/1997 | Stephany et al. | |
| 5,861,692 | A | 1/1999 | Furlani et al. | |
| 5,901,893 | A | 5/1999 | Furlani et al. | |
| 6,034,457 | A | 3/2000 | Furlani et al. | |
| 6,330,415 | B1 | 12/2001 | Imamura et al. | |
| 6,496,675 | B1 | 12/2002 | Sugiyama et al. | |
| 6,641,513 | B1 | 11/2003 | Ward et al. | |
| 2003/0075105 | A1 * | 4/2003 | Plaetzer | 118/423 |

* cited by examiner

*Primary Examiner*—Bentsu Ro
(74) *Attorney, Agent, or Firm*—Vedder, Price, Kaufman & Kammholz, P.C.

(57) ABSTRACT

An assist drive assembly for adjusting tension in a web generated when the web is moved over a roller in a contacting relationship therewith. A plurality of north and south pole elements are disposed about the roller. A controller is coupled to a magnetic pole sensor and an magnetic coil. The magnetic pole sensor and magnetic coil are disposed adjacent the north and south pole elements such that, when, during rotation of the roller in a direction of rotation, as a result of the web moving over the roller, the magnetic pole sensor observes a south pole element a first signal is generated that actuates the controller to energize the magnetic coil to generate a north pole field that attracts an immediately adjacent south pole element thereby imparting a torque to the roller in a direction of rotation of the roller.

25 Claims, 7 Drawing Sheets

Performance Results Without Assist Drive

| Test | 1 | 2 | 3 | 4 | 5 | 6 | 7 | 8 |
|---|---|---|---|---|---|---|---|---|
| Web Speed (feet/min) | 384.50 | 1137.50 | 1346.50 | 1581.00 | 2245.00 | 2299.50 | 1799.00 | 410.50 |
| Exit Web Tension | 0.99 | 1.09 | 1.02 | 1.01 | 0.97 | 1.03 | 0.94 | 1.01 |
| Entrance Web Tension | 0.83 | 0.83 | 0.72 | 0.66 | 0.27 | 0.44 | 0.58 | 0.97 |

FIG. 7

Performance Results With Assist Drive

| Test | 1 | 2 | 3 | 4 | 5 | 6 | 7 | 8 |
|---|---|---|---|---|---|---|---|---|
| Web Speed (feet/min) | 269.00 | 1039.00 | 1483.50 | 1854.50 | 2299.50 | 2182.50 | 1267.00 | 164.50 |
| Exit Web Tension | 0.90 | 1.18 | 1.04 | 1.01 | 1.03 | 1.00 | 0.95 | 1.00 |
| Entrance Web Tension | 0.83 | 1.16 | 1.04 | 1.01 | 0.95 | 0.79 | 1.05 | 0.98 |

FIG. 8

WEB ROLLER ASSIST DRIVE

This application claims the benefit of U.S. Provisional application No. 60/513,262, filed Oct. 22, 2003.

The present disclosure is directed to rollers used in connection with moving a web of material, and more particularly, to a non-contact electromagnetic assist drive for a roller which allows high speed transfer of light weight web materials.

The printing, packaging and converting industries all use manufacturing processes which generally include a roll of web material which is fed through a machine or series of machines to produce a finished end product. These inline processes enable short runs of high-quality product delivered on-demand. Further, significant advantages in price, delivery time and run length have been proven with respect to individual sheet-fed processes.

The rolls of web material may take various different forms. For example, webs of paper, film or non-woven materials may be used. Moreover, a wide range of line speeds are used throughout the industry. Speeds range approximately from 100 feet-per-minute (fpm) to 1500 fpm. It will be recognized by those of skill in the art that higher line speeds are desirable for a variety of reasons, such as, but not limited to, shorter turn around, less lead time, more throughput, quicker return on investment and higher customer service level.

Advantageous line speeds have been limited in the prior art by structural limitations. The path of the web of material which is being processed or converted into a finished product, always encounters a plurality of rollers. These rollers are necessary to re-direct, phase or orient the web of material as necessary with respect to the next process step. Each roller rotates as a result of the web of material making contact with and passing over such idler roller. However, each roller is usually mounted to a shaft via at least one bearing. The roller and bearing each have a significant amount of inertia and friction with respect to the web of material which must be overcome during the process or conversion in order for the web to pass without damage. The friction of the bearings in the idler rollers dictates the minimum running tension of lightweight web materials. Every roller a web of material passes over requires some web tension to keep the roller spinning. Accordingly, the web when passing over the roller at the beginning of the process has a very low tension, while the web when passing over the roller at the end of the process has a very high tension. An increase in tension decreases the speed at which the web may be fed through the process.

Prior art attempts to overcome the disadvantages and limitations discussed above are generally directed to an idler roller assistance method typically known as a tendency drive. One of the prior art attempts drives the idler roller shaft by some mechanical means so that the bearing friction works in favor of the web as opposed to against it. This mechanical drive means requires many mechanisms, is relatively expensive and are not practical in most applications. Another prior art method to overcome the disadvantages and limitations discussed above floats the idler roller on an air bearing to eliminate the drag of a mechanical bearing friction. This prior art attempt requires a regenerative blower or compressed air in a precise combination of air flow and tension level. Accordingly, the air bearing is susceptible to contamination.

It will be recognized by a one of skill in the art that each proposed solution to overcome the disadvantage of the prior art requires a significant amount of capital investment in equipment and a further commitment as to operation costs. Further, the mechanical drive means also must be controlled such that each roller in the system rotates at an appropriate desired speed. Often a differential in speeds between different rollers is need. This adds to the complexity of the installation and operation.

Another disadvantage of the pneumatic bearing or mechanical drive of the prior art is that each will disable the associated roller when the tendency drive is not energized, i.e. air or electrical energy is not applied. As a result, the web will usually tear, the entire process will be shut down in order to diagnose the problem and valuable production time and material is lost.

Another limitation with respect to line speed, is the web material itself. In order to achieve the higher feed speeds discussed above, a significant amount of tension must be placed on the web material in order to overcome the friction of the rollers and other frictional losses in the process, as briefly discussed above. It will be recognized by those of skill in the art that heavier weight web materials may easily withstand higher tension forces required by the friction in the process. However, the printing, packaging and converting industries, other than heavy weight carton making are all moving to thinner and more fragile materials. As a result, the tension force which may be applied to these light weight webs of material must be reduced or risk tearing the web. Consequently, line speeds must be reduced when light weight webs of material are used. The prior art attempts, i.e., air bearings and motorized roller shafts, fail to overcome these disadvantages and limitations.

Therefore, there exists a need in the art for an inexpensive, independent, unrestricted, easy-to-use, retro-fittable device which has minimal capital investment and on-going operational expenses, enables lower web tensions never before possible (near zero tension difference between the entrance roller and the exit roller of a process), actually assists the web of material running over the roller in proportion to the mass of the web passing over the roller, adjusts the amount of assistance provided in response to the speed of the web of material and has a virtually infinite line speed range.

BRIEF DESCRIPTION OF THE DRAWINGS

Certain embodiments are shown in the drawings. However, it is understood that the present disclosure is not limited to the arrangements and instrumentality shown in the attached drawings, wherein:

FIG. 7 illustrates performance results of the web processing assembly without the assist drive; and FIG. 8 illustrates performance results of the web processing assembly with the assist drive assembly.

DETAILED DESCRIPTION

Figure 1:
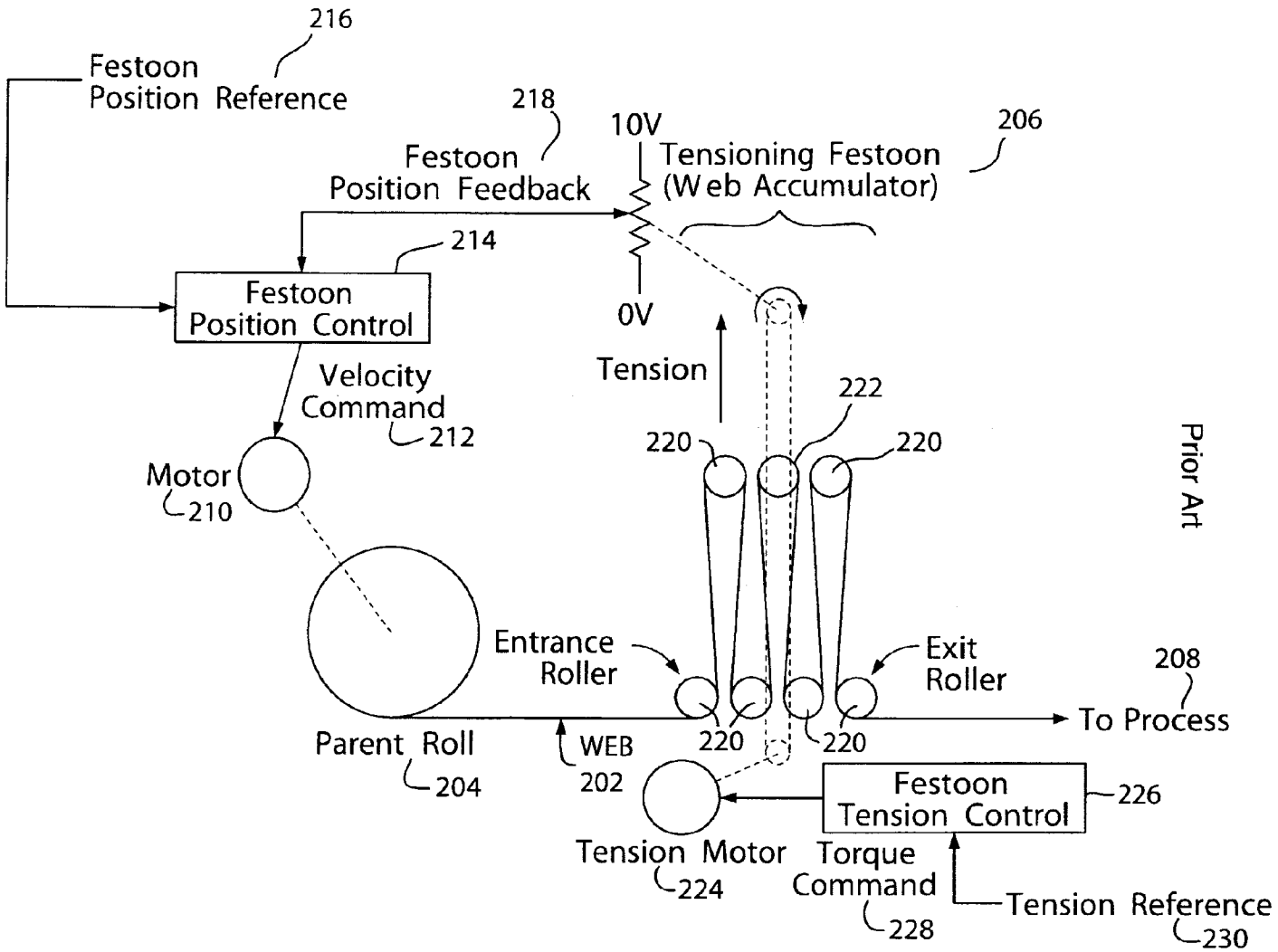
FIG. 1 illustrates a schematic representation of a portion of a conventional web processing assembly.

For the purposes of promoting and understanding the principles disclosed herein, reference will now be made to the preferred embodiments illustrated in the drawings and specific language will be used to describe the same. It will nevertheless be understood that no limitation of the scope is thereby intended. Such alterations and further modifications in the illustrated device and such further applications are the principles disclosed as illustrated therein as being contemplated as would normally occur to one skilled in the art to which this disclosure relates.

In accordance with one principle aspect to the present disclosure, an assist drive assembly for adjusting tension in a web generated when the web is moved over a roller in a contacting relationship therewith, comprises a plurality of north and south pole elements disposed on the roller. A controller is coupled to a magnetic pole sensor and an magnetic coil. The magnetic pole sensor and magnetic coil are disposed adjacent the north and south pole elements such that when, during rotation of the roller in a direction of rotation as a result of the web moving over the roller, the magnetic pole sensor observes a south pole element a first signal is generated that actuates the controller to energize the magnetic coil to generate a north pole field that attracts an immediately adjacent south pole element thereby imparting a torque to the roller in a direction of rotation of the roller.

In another principle aspect of the present disclosure, a roller assist drive assembly comprises a roller including a plurality of alternating north and south pole elements disposed thereon. A magnetic pole sensor, a south pole magnetic coil and a north pole magnetic coil are all disposed about the roller, such that as a result of rotation of the roller the magnetic pole sensor energizes the south and north pole magnetic coils upon observation of a north pole element so that the energized south pole magnetic coil attracts an adjacently disposed north pole element and the energized north pole magnetic coil repels an adjacently disposed north pole element thereby imparting a torque to the roller in a direction of rotation of the roller.

In another principle aspect of the present disclosure, a web processing assembly comprises a plurality of rollers over which the moving web passes. At least one of the rollers includes a plurality of alternating north and south pole elements disposed thereon A magnetic pole sensor, a south pole magnetic coil and a north pole magnetic coil, are all disposed about each at least one roller, such that as a result of rotation of each at least one roller the magnetic pole sensor energizes the south and north pole magnetic coils upon observation of a north pole element so that the energized south pole magnetic coil attracts an adjacently disposed north pole element and the energized north pole magnetic coil repels an adjacently disposed north pole element thereby imparting a torque to the roller in a direction of rotation of the roller.

FIG. 1 illustrates a schematic representation of a portion of a conventional web processing assembly 200. A web of material 202 is disposed on a parent roll 204 and is fed out for processing through a tensioning festoon 206 before being fed to a further processing step 208. The parent roll 204 is driven by a motor 210 which receives a velocity command 212 from a festoon position control 214. The festoon position control 214 has at least two inputs, namely, a festoon position reference 216 and a festoon position feedback 218, from which the festoon position control 214 determines the velocity command 212.

The tensioning festoon 206 includes a plurality of fixed rollers 220 that are free to rotate about their axes on a support as will be discussed in more detail herein. A dancer roller 222 is provided in the tensioning festoon 206 and is mounted for rotation about its axis on a floating support or carriage. The web material 202 passes around the fixed rollers 220 and the dancer roller 222 before it exits from the tensioning festoon 206. The position of the carriage or dancer roller 222 with respect to the idler rollers 220 has been used in the past to determine the tension on the web material 202 as it passes through the tensioning festoon 206. A motor 224 controls the position of the dancer roller 222 in response to the festoon tension control 226 which receives a torque command 228 from a preset tension reference 230.

Festoons are known and recognized in the art as excellent means for preventing fluctuation and tension in one region of a moving web material from causing tension changes in another down stream region of a the web of material. Such tensioning festoons are integral part of web butt splicers and other similar high-speed handling equipment for use in connection with web, processing equipment. For example, tensioning festoons may provide the web storage needed to permit a zero-speed butt splice to be made while a downstream portion of the web material on the expiring roll continues to be fed at normal speed to continuous web processing equipment.

However, as web processing systems evolve and new web materials are created, certain applications require the web material to be run at relatively high web speeds and under relatively low tensions so as to avoid permanently deforming the webs during operation and for other advantages described above and below. It has been found that conventional tensioning festoon assemblies and other web processing systems have been inadequate. Accordingly, a novel solution in accordance with the teachings of the present disclosure will overcome the disadvantages of prior efforts.

Figure 2:
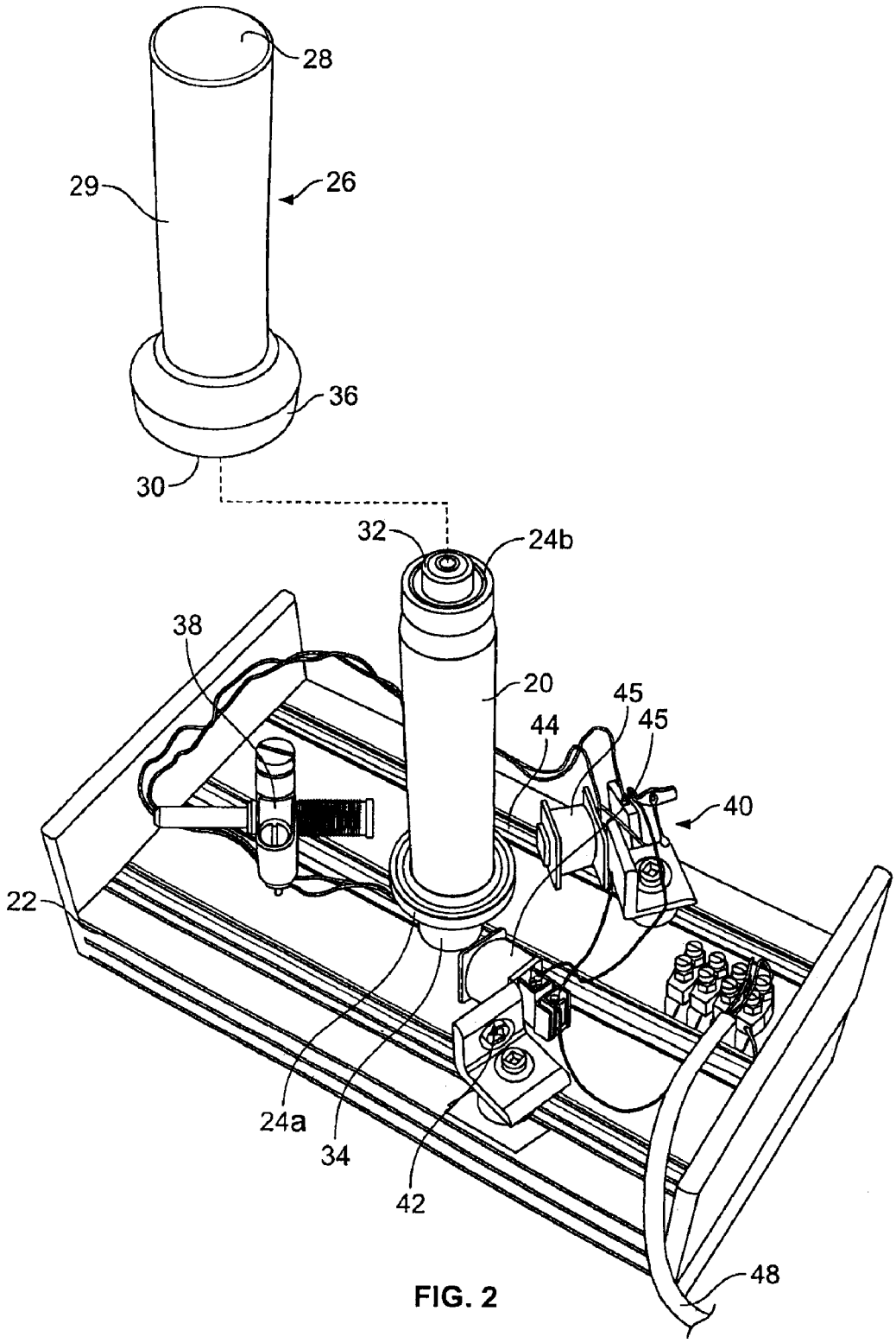
FIG. 2 illustrates a detailed exploded view of an assist drive assembly adapted for operative association with a roller for use in the web processing assembly.
Figure 3:
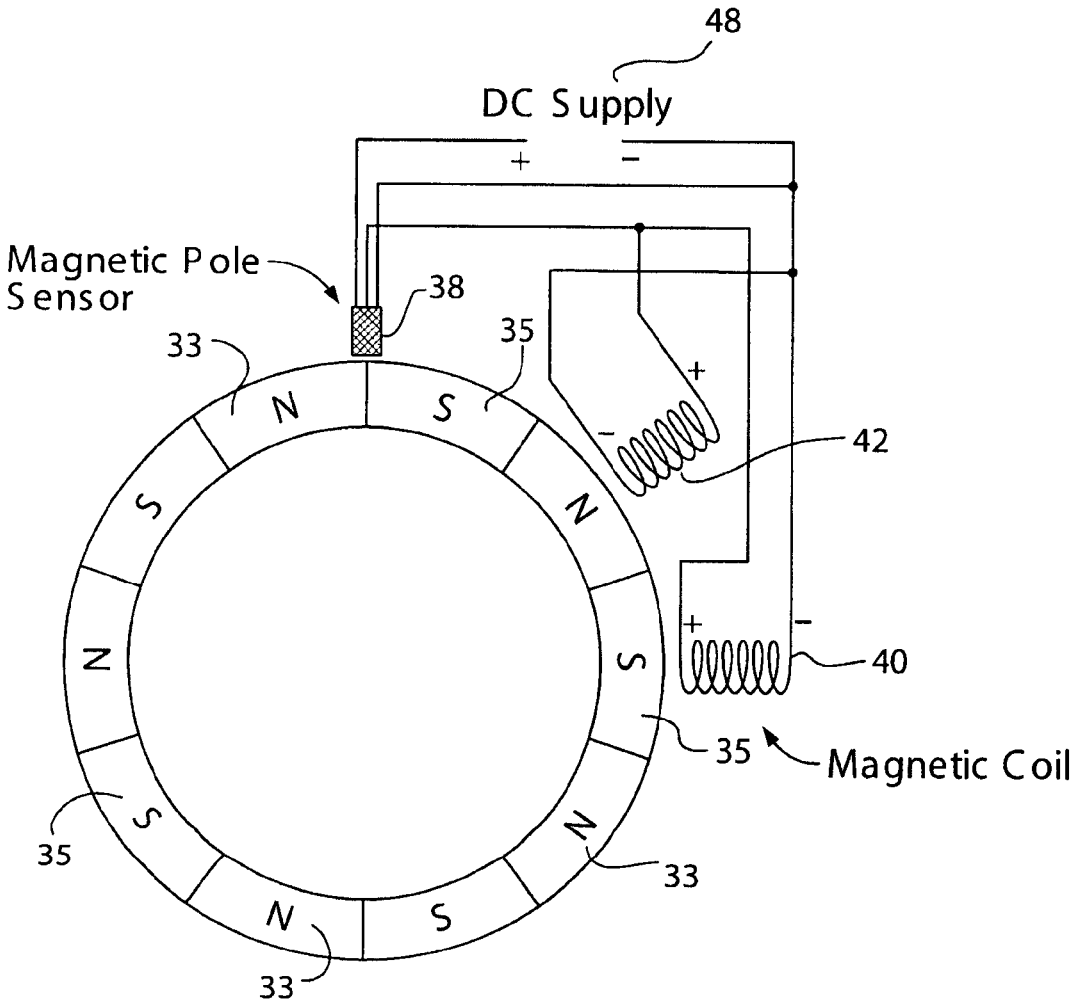
FIG. 3 illustrates a schematic representation of the assist drive assembly of FIG. 2.

FIG. 2 illustrates the component parts of one embodiment of the assist drive of the present disclosure which is adapted to be operatively associated with a roller. FIG. 3 illustrates a schematic representation of the assist drive assembly of FIG. 2 where a considerable amount of the structure of the assist drive of FIG. 2 is removed for clarity. It will be recognized by those of skill in the art that FIGS. 2 and 3 illustrate a simplified working example of the present invention sufficient to enable explanation of how to make and use the present disclosure. It will be further recognized by those of skill in the art that the assist drive of the present disclosure may be applied to any roller or rollers in a printing, packaging or converting process known in the prior art.

In this embodiment, a roller shaft 20 is connected to a base 22. It will be recognized by those of skill in the art that as used in the intended environment, the roller shaft 20 may be supported at the proximal end 34 as shown in FIG. 1, the proximal and distal ends 34, 32 or solely the distal end 32, as desired. In this embodiment, the roller shaft 20 is supported at a first proximal end 34 adjacent the base 22. The base 22 as shown and described is generally representative of what one of skill in the art would expect to find in the working environment. For example, a base 22 may be a wall or other substantially rigid and fixed substrate in a permanent installation or the base may be a portion of an individual piece of equipment used in the web processing system where the piece of equipment may be mobile for performing an identical function in a different location or in a different web processing system. A pair of roller bearings 24*a*, 24*b* are connected to respective proximal and distal ends 34, 32 of the roller shaft 20.

A generally tubular roller shell 26 defines an inner surface which is configured to engage an external surface of the outer race of the roller bearings 24*a*, 24*b* of the roller shaft 20. The roller shell 26 has a closed end 28, a wall 29 and an open end 30. The open end 30 is fitted over the distal end 32 of the idler roller shaft 20 and when installed is disposed engaging the roller bearing 24*a* at the proximal end 34 of the idler roller shaft 20. The roller bearing 24*b* disposed adjacent to the distal end 32 of the idler roller shaft 20 engages an inner surface (not shown, but see FIG. 6) of the wall 29 adjacent the closed end 28.

A plurality of alternating north and south magnetic pole elements 33, 35 (not visible in FIG. 2, but schematically represented in FIGS. 3–5) are disposed in sequence about the circumference of the roller shell 26. In one embodiment, a magnet ring 36 may be configured to include the alternately disposed north and south pole elements for connection to the roller shell 26 adjacent the open end 30. The north and south pole elements 33, 35 are preferably equally spaced about the circumference of the roller shell 26 or the magnet ring 36. However, it will be recognized by those of skill in the art that the north and south pole elements 33, 35 may be arranged in any desirable configuration so that the intended function is accomplished.

A magnetic pole sensor 38, a south pole magnetic coil 40 and a north pole magnetic coil 42 are disposed on the base 22 about the periphery of the roller shell 26, when the roller shell 26 is connected to the roller shaft 20. It will be recognized by those of skill in the art that the magnetic coils 40, 42 may include a core 44 about which windings 45 are disposed such that current passed through the windings 45 induces a magnetic field focused in the core 44. The magnetic pole sensor 38 and north and south pole magnetic coils 40, 42 are structurally configured to achieve the novel function of the present disclosure as will be discussed in detail below. Preferably, the north and south pole elements 33, 35, which may be configured as a magnet ring 36, disposed on the roller shell 26 adjacent to the open end 30, the magnetic pole sensor 38 and the north and south pole magnetic coils 40, 42 are all disposed approximately in the same plane. An electrical power source 48 is applied to the magnetic pole sensor 38 and north and south pole magnetic coils 40, 42 and functions as discussed below.

In the embodiment described in FIGS. 2 and 3, the magnetic pole sensor 38 is configured such that when a north pole element 33 on the roller shell 26 or magnet ring 36 is observed, the magnetic pole sensor 38 functions to close a normally open switch (not shown) disposed therein or operatively associated therewith. As a result, in one embodiment, electrical current is directed to the windings 45 of one of the south and north pole magnetic coils 42, 44 such that the windings 45 of such north or south magnetic coil 42, 44 is energized. In another embodiment, electrical current is directed to the windings 45 of both the north and south magnetic coils 42, 44 such that the windings 45 of both north and south magnetic coil 42, 44 are energized. Upon being energized, the core 44 of one or both magnetic coils 40, 42 become magnetized. The core 44 of the south pole magnetic coil 40 is magnetized such that the south pole of the core 44 is disposed adjacent the magnet ring 36. The core 44 of the north pole magnetic coil 42 is magnetized such that the north pole of the core 44 is disposed adjacent the magnet ring 36. When the magnetic pole sensor 38 no longer senses a north pole or senses a south pole on the roller shell 26 or the magnet ring 36, the switch (not shown) returns to the normally open orientation such that the south and north pole magnetic coils 40, 42 are de-energized or are not energized.

In another embodiment, a processor (see FIG. 5) may be electrically coupled between the magnetic pole sensor 38 and the north and south pole magnetic coils 40, 42 which executes instructions stored in memory to control the energizing of the north and south pole magnetic coils 40, 42. It will be recognized by those of skill in the art that the processor may be, but is not limited to, a single processor, a plurality of processors, a DSP, a microprocessor, ASIC, state machine, or any other implementation capable of processing and executing software or firmware. The term processor should not be construed to refer exclusively to hardware capable of executing software, and may implicitly include DSP hardware, ROM for storing software, RAM and any other volatile or non-volatile storage medium. The memory may be, but not limited to, a single memory, a plurality of memory locations, shared memory, CD, DVD, ROM, EEPROM, optical storage, micro code or any other non-volatile storage capable of storing digital or analog data for use by the processor.

In operation of this embodiment, as described above with respect to FIG. 1, a web material passing over the roller shell 26 at a low line speed begins initial rotation of the roller 20 in a direction of rotation. As the alternating north and south pole magnetic elements 33, 35 on the roller shell 26 or the magnet ring 36 are passed before the magnetic pole sensor 38, the magnetic pole sensor 38 alternately closes and opens the switch (not shown) to energize one of or both the south and north pole magnetic coils 40, 42 and to de-energize or not energize the south and north pole magnetic coils 40, 42, respectively. Observation of a north pole element 33 by the magnetic pole sensor 38 causes the magnetic pole sensor 38 to close the switch (not shown). Whereas, observation of a south pole element 35 or observation of the lack of a north pole element 33 by the magnetic pole sensor 38 causes the magnetic pole sensor 38 to open the switch (not shown).

FIG. 3 further illustrates the physical configuration and orientation of the structural elements in this embodiment. The south pole magnetic coil 40 is oriented with respect to the roller shell 26 or the magnet ring 36 such that when the magnetic pole sensor 38 observes a north pole element 33, the south pole magnetic coil 40 is energized with a south polarity in order to attract the approaching north pole element 33. Likewise, the north pole magnetic coil 42 is disposed such that when the magnetic pole sensor 38 observes the north pole element 33 discussed immediately above, the north pole magnetic coil 42 is energized with a north polarity in order to repel the adjacent passing north pole element 33 and attract the adjacent oncoming south pole element 35 on the roller shell 26 or the magnet ring 36. The present disclosure may operated at any speed, such that the faster the web of material is passed or run over the roller, the faster the coils are energized and de-energized or not energized. As a result, a forward assistance or torque is always imparted in the direction of rotation of the roller 20 regardless of the speed of the roller 20 or the web passing over the roller 20.

Figure 4:
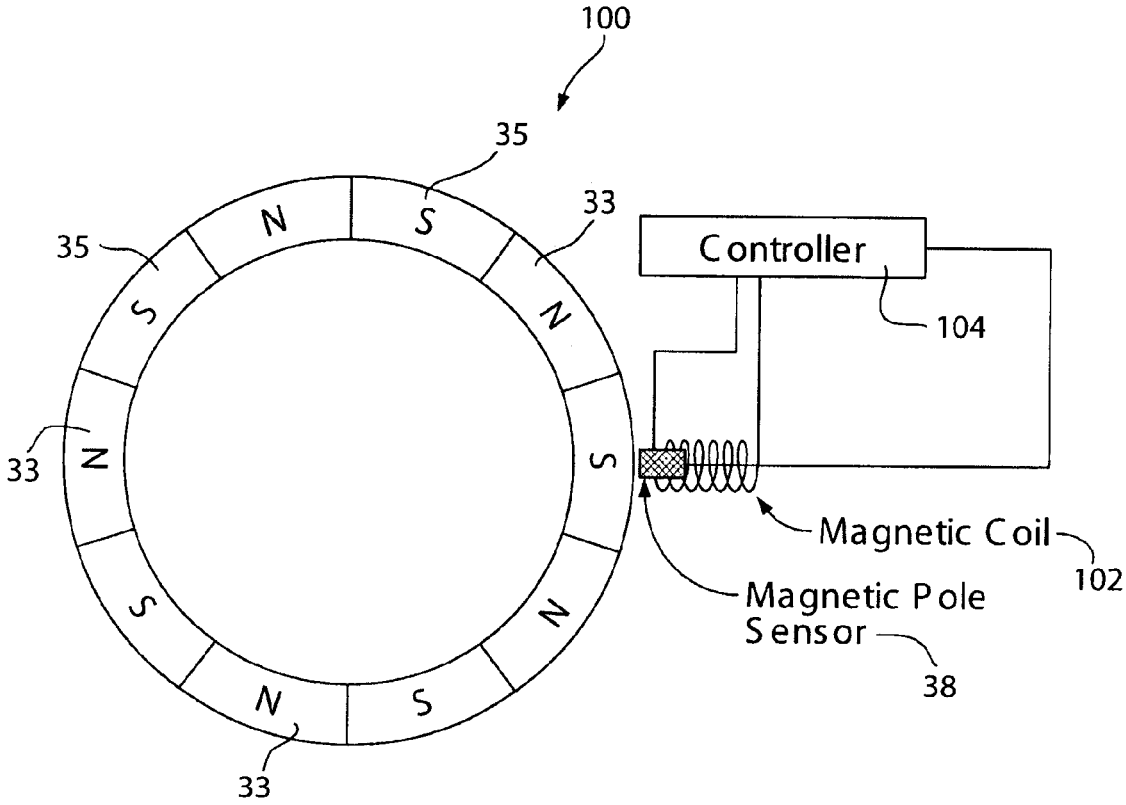
FIG. 4 illustrates a schematic representation of another embodiment of an assist drive assembly adapted for operative association with a roller for use in the web processing assembly.
Figure 5:
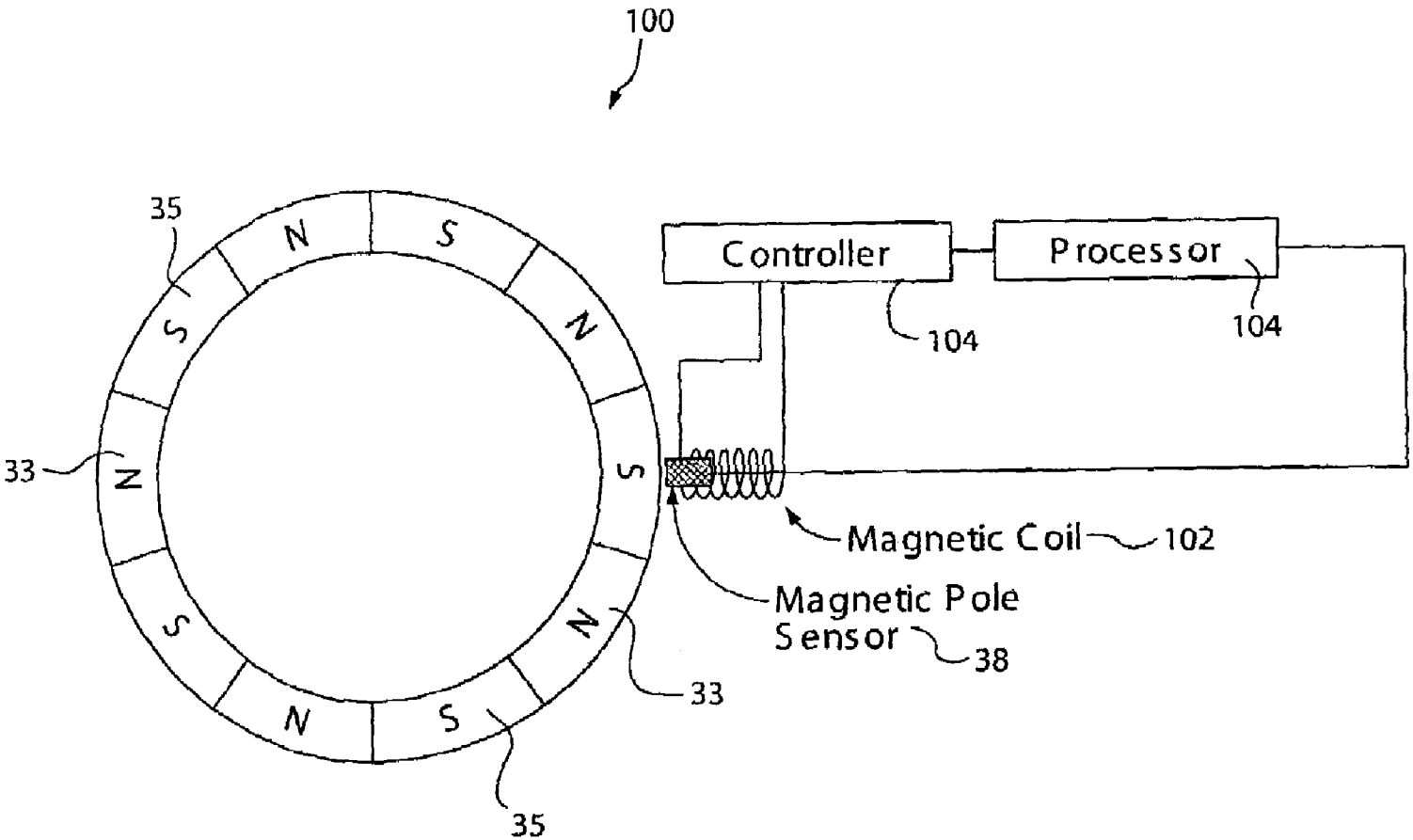
FIG. 5 illustrates a schematic representation of another embodiment of an assist drive assembly adapted for operative association with a roller for use in the web processing assembly.
Figure 6:
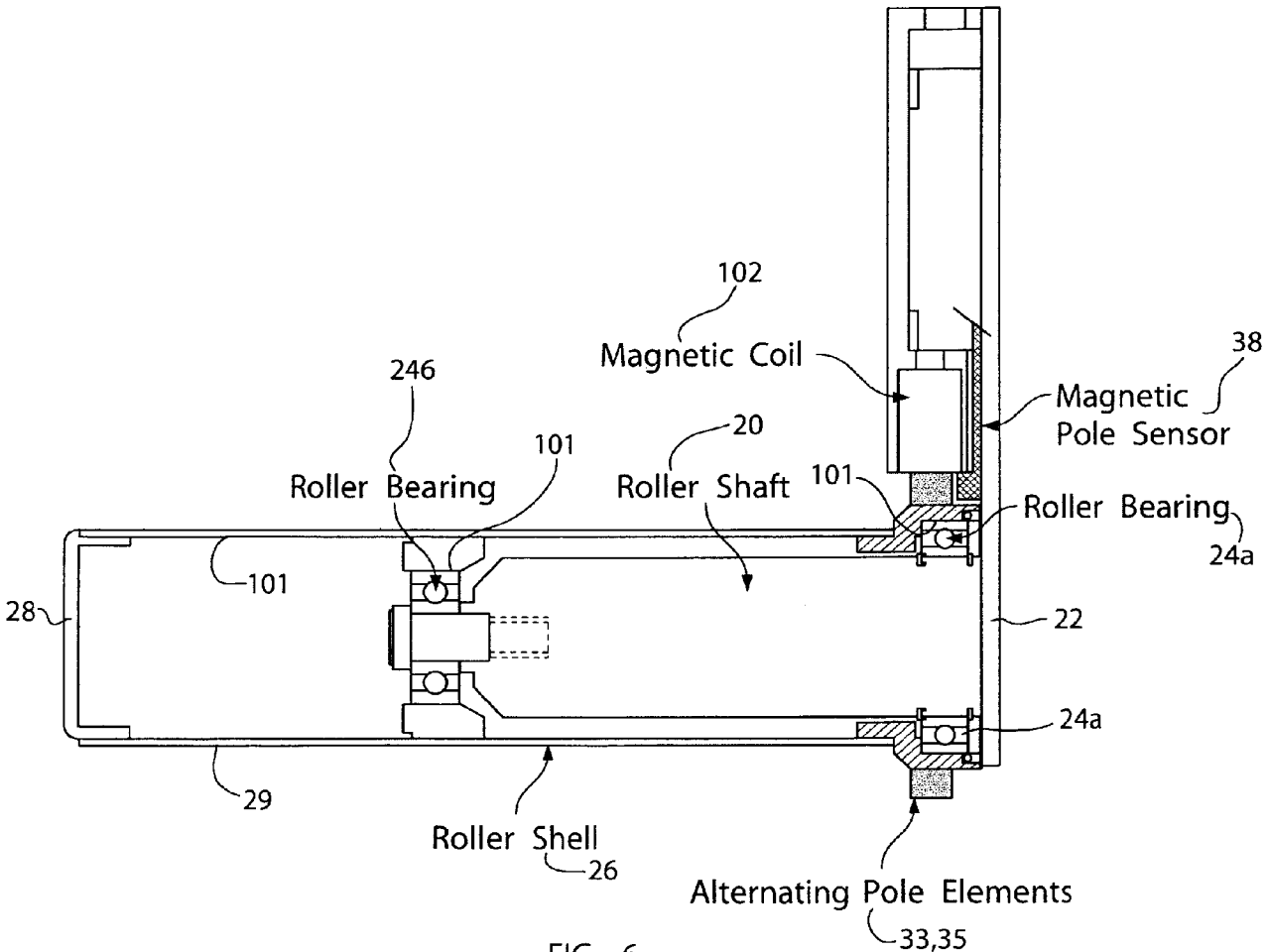
FIG. 6 illustrates a detailed cross-section view of the assist drive assembly of FIGS. 4 and 5.

FIGS. 4 and 5 illustrate schematic representations of other embodiments of an assist drive assembly 100 adapted for operative association with a roller for use in the web processing assembly. FIG. 6 illustrates a detailed cross-section view of the assist drive assembly of FIGS. 4 and 5. Many elements and the basic principles of operation are the same and similar to the embodiment described with respect to FIGS. 2 and 3. Accordingly, like elements will have the same reference numerals.

Generally, the roller 20, as similarly described above with respect to FIGS. 2 and 3, is connected to a base 22. It will be recognized by those of skill in the art that as used in the intended environment, the roller shaft 20 may be supported at the proximal end 34 as shown in FIG. 6, the proximal and distal ends 34, 32 or solely the distal end 32, as desired. In this embodiment, the roller shaft 20 is supported at a first proximal end 34 adjacent the base 22. The base 22 as shown and described is generally representative of what one of skill in the art would expect to find in the working environment. For example, a base 22 may be a wall or other substantially rigid and fixed substrate in a permanent installation or the base may be a portion of an individual piece of equipment used in the web processing system where the piece of equipment may be mobile for performing an identical function in a different location or in a different web processing system. A pair of roller bearings 24*a*, 24*b* are connected to respective proximal and distal ends 34, 32 of the roller shaft 20.

A generally tubular roller shell 26 defines an inner surface which is configured to engage an external surface of the outer race of the roller bearings 24*a*, 24*b* of the roller shaft 20. The roller shell 26 has a closed end 28, a wall 29 and an open end 30. The open end 30 is fitted over the distal end 32 of the idler roller shaft 20 and when installed is disposed engaging the roller bearing 24*a* at the proximal end 34 of the idler roller shaft 20. The roller bearing 24*b* disposed adjacent to the distal end 32 of the idler roller shaft 20 engages an inner surface 101 of the wall 29 adjacent the closed end 28.

As shown in FIGS. 4–6, a plurality of alternating north and south magnetic pole elements 33, 35 are disposed in sequence about the circumference of the roller shell 26. In one embodiment, a magnet ring may be configured to include the alternately sequentially disposed north and south pole elements 33, 35 for connection to the roller. The north and south pole elements 33, 35 are preferably equally spaced in sequence about the circumference of the roller shell 26 or the magnet ring. However, it will be recognized by those of skill in the art that the north and south pole elements 33, 35 may be arranged in any desirable configuration so that the intended function is accomplished.

A magnetic pole sensor 38 is disposed on the base about the periphery of the roller shell 26, when the roller shell 26 is connected to the roller shaft 20. A magnetic coil 102, similar in structure and function to the north and south pole magnetic coils 40, 42 described above, is superimposed over the magnetic pole sensor 38 such that the magnetic coil 102 and magnetic pole sensor 38 are aligned parallel, preferably axially parallel and nearly contiguous. It will be recognized by those of skill in the art that the magnetic pole sensor 38 is preferably shielded to avoid false signals or inputs as a result of the close proximity with the magnetic coil 102.

The structure and function of the magnetic coil 102 will be recognized by one of skill in the art to preferably include a core about which windings are disposed such that current passed through the windings induces a magnetic field focused in the core. The magnetic coil 102 may be energized with current to produce a north pole magnetic field or a south pole magnetic field, depending how the magnetic coil 102 is energized, which will be described in detail below.

In this embodiment, the magnetic pole sensor 38 functions slightly differently than the same element as described with respect to FIGS. 2 and 3. In this embodiment, during rotation of the roller in the direction of rotation as a result of the web moving over the roller, the magnetic pole sensor 38, upon observation of a south pole element 35, generates a first signal. During further rotation of the roller in the direction of the roller and upon observation of a north pole element 33 or failure to observe a south pole element 35 (depending on how the magnetic pole sensor 38 is configured or designed), the magnetic pole sensor 38 generates a second signal. It will be recognized by those of skill in the art that the second signal may be an omission, lack of a signal or a null signal rather than a positive or actual signal.

A controller 104 is electrically coupled to the magnetic pole sensor 38 and the magnetic coil 102. Generally, the controller 104 performs a switching function. The first signal from the magnetic pole sensor 38 actuates the controller 104 to energize the magnetic coil 102 to generate a north pole field which attracts an immediately adjacent south pole element thereby imparting a torque to the roller in the direction of rotation of the roller. When the controller 104 does not receive the first signal, the controller 104 is disposed in a ready state where the magnetic coil 102 is no longer energized.

The second signal, in whatever format or configuration, from the magnetic pole sensor 38, actuates the controller 104 to energize the magnetic coil 102 to generate a south pole field that attracts an immediately adjacent north pole element 33 thereby imparting a torque to the roller in the direction of rotation of the roller.

The controller 104 may be configured as an H-bridge amplifier and the magnetic pole sensor may be configured as a Hall-effect integrated circuit.

In the embodiment disclosed in FIG. 5, a processor 106 may be electrically coupled between the magnetic pole sensor 38 and the magnetic coil 102 to control energizing of the magnetic coil 102. Preferably, the processor 106 is disposed between the magnetic pole sensor 38 and the controller 104. The processor 106 executes instructions stored in memory to control the actuation of the controller 102 for energizing of the magnetic coil 102. It will be recognized by those of skill in the art that the processor may be, but is not limited to, a single processor, a plurality of processors, a DSP, a microprocessor, ASIC, state machine, or any other implementation capable of processing and executing software or firmware. The term processor should not be construed to refer exclusively to hardware capable of executing software, and may implicitly include DSP hardware, ROM for storing software, RAM and any other volatile or non-volatile storage medium. The memory may be, but not limited to, a single memory, a plurality of memory locations, shared memory, CD, DVD, ROM, EEPROM, optical storage, micro code or any other non-volatile storage capable of storing digital or analog data for use by the processor.

FIGS. 7 and 8 illustrate tension performance results of the web processing assembly without and with the assist drive assembly, respectively. In FIG. 7, the exit web tension was regulated to approximately one (1) pound of tension as the web speed, measured in feet per minute, was increased. The cumulative effect of friction and inertia from the rollers in the web processing system on the entrance web tension, as the web speed is increased, causes the entrance web tension to decrease dramatically. As a result of the low entrance web tension, the web becomes unstable and hard to process. Consequently, the exit web tension limits the overall performance of the web processing system.

Preferably, the web tension is relatively consistent throughout the web processing system. FIG. 8 illustrates the tension performance results from the same web processing system as FIG. 7 with the same web material also regulated to one (1) pound of tension at the exit roller, but with one embodiment of the present disclosure in use. Regardless of the increase in web speed, the web tension at the entrance roller and the exit roller remains relatively the same. As a result, the web is easier to process and the lowest sustainable web tension for proper web processing without errors may be explored and web speed may be increased beyond know limits.

The present disclosure is advantageous in that no external speed signal input is required. Further, the present disclosure is totally self-contained and operates off a continuous power supply which may be 24-volts DC or any other suitable power supply. Another advantage of the present disclosure is that the speed of various rollers in a system may operate at a differential without requiring different speed signals or synchronization there between. Moreover, the present disclosure may be implemented where otherwise an isolation nip, drive and tensioning method would be required. Finally, when de-energized or not energized, as the case may be, a roller incorporating any embodiment of the present disclosure will also function as a standard roller. In the event one component of the present disclosure fails, the system can still perform, obviously though not at the same speed or consistent tension level, unless a number of other rollers in the web processing system incorporate any embodiment of the present disclosure.

Furthermore, while the particular preferred embodiments have been shown and described, it will be obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A roller assist drive assembly comprising:

a roller including a plurality of alternating north and south pole elements disposed in sequence about the circumference thereof, a magnetic pole sensor, a south pole magnetic coil and a north pole magnetic coil, all disposed in a spaced relation about the roller, such that as a result of rotation of the roller the magnetic pole sensor energizes the south and north pole magnetic coils upon observation of a north pole element so that the energized south pole magnetic coil attracts an adjacently disposed north pole element and the energized north pole magnetic coil repels an adjacently disposed north pole element thereby imparting a torque to the roller in a direction of rotation of the roller.

2. The assembly as recited in claim 1, wherein the roller is adapted to engage at least one roller bearing disposed on a roller shaft.

3. The assembly as recited in claim 2, wherein the roller shaft is connected at a proximal end to a base.

4. The assembly as recited in claim 1, wherein the roller is configured as a generally cylindrical tubular shell.

5. The assembly as recited in claim 3, wherein a magnet ring is disposed on the roller adjacent the base.

6. The assembly as recited in claim 1, wherein the plurality of north and south pole elements are configured as a magnet ring.

7. The assembly as recited in claim 1, wherein the magnetic pole sensor is configured as a normally open switch that closes upon observation of the north pole element.

8. The assembly as recited in claim 1, further including a processor electrically coupled between the magnetic pole sensor and the north and south pole magnetic coils to control energizing of the north and south pole magnetic coils.

9. The assembly as recited in claim 1, wherein, upon failure to observe a north pole element, the magnetic pole sensor does not energize the south and north pole magnetic coils.

10. A web processing assembly comprising:

a plurality of rollers over which the moving web passes;

at least one of the rollers including a plurality of alternating north and south pole elements disposed in sequence about the circumference thereof;

a magnetic pole sensor, a south pole magnetic coil and a north pole magnetic coil, all disposed in a spaced relation about each at least one roller, such that as a result of rotation of each at least one roller the magnetic pole sensor energizes the south and north pole magnetic coils upon observation of a north pole element so that the energized south pole magnetic coil attracts an adjacently disposed north pole element and the energized north pole magnetic coil repels an adjacently disposed north pole element thereby imparting a torque to the roller in a direction of rotation of the roller.

11. The assembly as recited in claim 10, wherein each at least one roller is adapted to engage at least one roller bearing disposed on a roller shaft.

12. The assembly as recited in claim 11, wherein the roller shaft is connected at a proximal end to a base.

13. The assembly as recited in claim 10, wherein each at least one roller is configured as a generally cylindrical tubular skill.

14. The assembly as recited in claim 12, wherein the north and south pole elements are configured as a magnet ring disposed on the roller adjacent the base.

15. The assembly as recited in claim 10, wherein the magnetic pole sensor is configured as a normally open switch that closes upon observation of the north pole element.

16. The assembly as recited in claim 10, further including a processor electrically coupled between the magnetic pole sensor and the north and south pole magnetic coils to control energizing of the north and south pole magnetic coils.

17. The assembly as recited in claim 10, wherein upon observation of a south pole element the magnetic pole sensor de-energizes the south and north pole magnetic coils.

18. An assist drive assembly for adjusting tension in a web generated when the web is moved over a roller in a contacting relationship therewith, the assembly comprising:

a plurality of north and south pole elements sequentially disposed about a circumference of the roller;

a controller electrically coupled to a magnetic pole sensor and an magnetic coil; and the magnetic pole sensor and magnetic coil are disposed adjacent the north and south pole elements such that when, during rotation of the roller in a direction of rotation as a result of the web moving over the roller, the magnetic pole sensor observes a south pole element a first signal is generated that actuates the controller to energize the magnetic coil to generate a north pole field that attracts an immediately adjacent south pole element thereby imparting a torque to the roller in a direction of rotation of the roller.

19. The assembly as recited in claim 18, wherein when, during rotation of the roller, the magnetic pole sensor observes a north pole element a second signal is generated that actuates the controller to energize the magnetic coil to generate a south pole field that attracts an immediately adjacent north pole element thereby imparting a torque to the roller in the direction of rotation of the roller.

20. The assembly as recited in claim 18, wherein the north and south pole elements are spaced at equal intervals.

21. The assembly as recited in claim 18, wherein the controller is configured as an H-bridge amplifier.

22. The assembly as recited in claim 18, wherein the magnetic pole sensor is configured as a Hall-effect sensor integrated circuit.

23. The assembly as recited in claim 18, further including a processor electrically coupled between the magnetic pole sensor and the magnetic coil to control energizing of the magnetic coil.

24. The assembly as recited in claim 23, wherein the processor is disposed between the magnetic pole sensor and the controller.

25. The assembly as recited in claim 18, wherein the magnetic coil is superimposed over the magnetic coil sensor.

* * * * *